United States Patent [19]

Ise

[11] Patent Number: 4,655,692

[45] Date of Patent: Apr. 7, 1987

[54] EJECTOR PUMP HAVING PRESSURE OPERATED MOTIVE FLUID VALVE AND ELECTROMAGNETIC CHANGE-OVER VALVE

[75] Inventor: Yoji Ise, Tokyo, Japan

[73] Assignee: Myotoku Ltd., Tokyo, Japan

[21] Appl. No.: 743,096

[22] Filed: Jun. 10, 1985

[30] Foreign Application Priority Data

Jun. 20, 1984 [JP] Japan ..... 59-92400[U]

[51] Int. Cl.[4] ..... F04F 5/48

[52] U.S. Cl. ..... 417/187; 294/64.2

[58] Field of Search ..... 417/182, 184, 187–189; 294/64.2

[56] References Cited

U.S. PATENT DOCUMENTS

| | | | |
|---|---|---|---|
| 988,224 | 3/1911 | Sweeny et al. | 417/189 X |
| 1,873,623 | 8/1932 | Morrison | 417/187 |
| 2,874,989 | 2/1959 | Reynolds | 417/187 X |
| 3,967,849 | 7/1976 | Cagle | 417/184 X |
| 4,178,760 | 12/1979 | Alf et al. | 417/191 X |
| 4,402,651 | 9/1983 | Ise | 417/182 |
| 4,549,854 | 10/1985 | Yamamoto | 417/187 |

FOREIGN PATENT DOCUMENTS

| | | | |
|---|---|---|---|
| 2655308 | 6/1978 | Fed. Rep. of Germany | 417/182 |
| 25905 | 3/1978 | Japan | 417/182 |
| 51998 | 4/1980 | Japan | 417/187 |
| 35299 | 3/1983 | Japan | 417/188 |
| 2033964 | 5/1980 | United Kingdom | 417/182 |

*Primary Examiner*—Carlton R. Croyle
*Assistant Examiner*—Paul F. Neils
*Attorney, Agent, or Firm*—Robert E. Burns; Emmanuel J. Lobato; Bruce L. Adams

[57] ABSTRACT

Herein disclosed is an ejector pump which can be used favorably with a sucking disk for carrying an article. In the bore of a pump body, there are fitted a nozzle block having a nozzle hole and an ejector block which has an ejector hole aligned with the nozzle hole of the nozzle block, so that a suction chamber formed between the nozzle hole and the ejector hole may communicate with a suction port which is formed in one side of the pump body. Fitted in the pump body, too, is a spool valve for opening or closing a communication passage providing communication between the nozzle hole and the compressed air inlet port of the pump body. The spool valve is controlled by an electromagnetic change-over valve disposed outside of the pump body. The pump has the advantage that the compressed air can be supplied at a high flow rate to establish a strong sucking force even with a relatively small-sized electromagnetic change-over valve.

2 Claims, 2 Drawing Figures

EJECTOR PUMP HAVING PRESSURE OPERATED MOTIVE FLUID VALVE AND ELECTROMAGNETIC CHANGE-OVER VALVE

BACKGROUND OF THE INVENTION

The present invention relates to an evacuator and, more particularly, to an ejector pump for establishing a vacuum in both a suction chamber and a system connected to the former by injecting compressed air from a nozzle hole into an ejector hole to suck into the injected jet the air which is stagnant in a suction chamber formed between the nozzle hole and the ejector hole.

SUMMARY OF THE INVENTION

It is an object of the present invention to provide an ejector pump which is able to establish a high suction and to open and close a nozzle very smoothly by establishing a large flow of compressed air even with the use of a relatively small-sized electromagnetic change-over valve. In order to achieve this object, the ejector pump is characterized by using a spool valve which is adapted to be actuated by the compressed air.

According to a major feature of the present invention, there is provided an ejector pump comprising; a pump body having a bore therein, a suction port formed in one side of the body and a compressed air inlet port at its outer side; a nozzle block having a nozzle hole; an ejector block having an ejector hole aligned with the nozzle hole of said nozzle block and fitted together with said nozzle block in the bore of said pump body to form a suction chamber between the nozzle hole of said nozzle block and the ejector hole of said ejector block, said suction chamber having communication with the suction port of said pump body; a spool valve fitted in said pump body and having a pressure chamber at the end portion thereof for opening or closing a communication passage providing communication between the nozzle hole and the compressed air inlet port of said pump body; and an electromagnetic change-over valve disposed outside of said pump body for changing over the communication of the pressure chamber of said spool valve with the compressed air inlet port of said pump body and the atmosphere to actuate said spool valve.

BRIEF DESCRIPTION OF THE DRAWINGS

Other objects, features and advantages of the present invention will become apparent from the following description taken in connection with one embodiment thereof with reference to the accompanying drawings, in which.

DESCRIPTION OF THE PREFERRED EMBODIMENT

Figure 1:
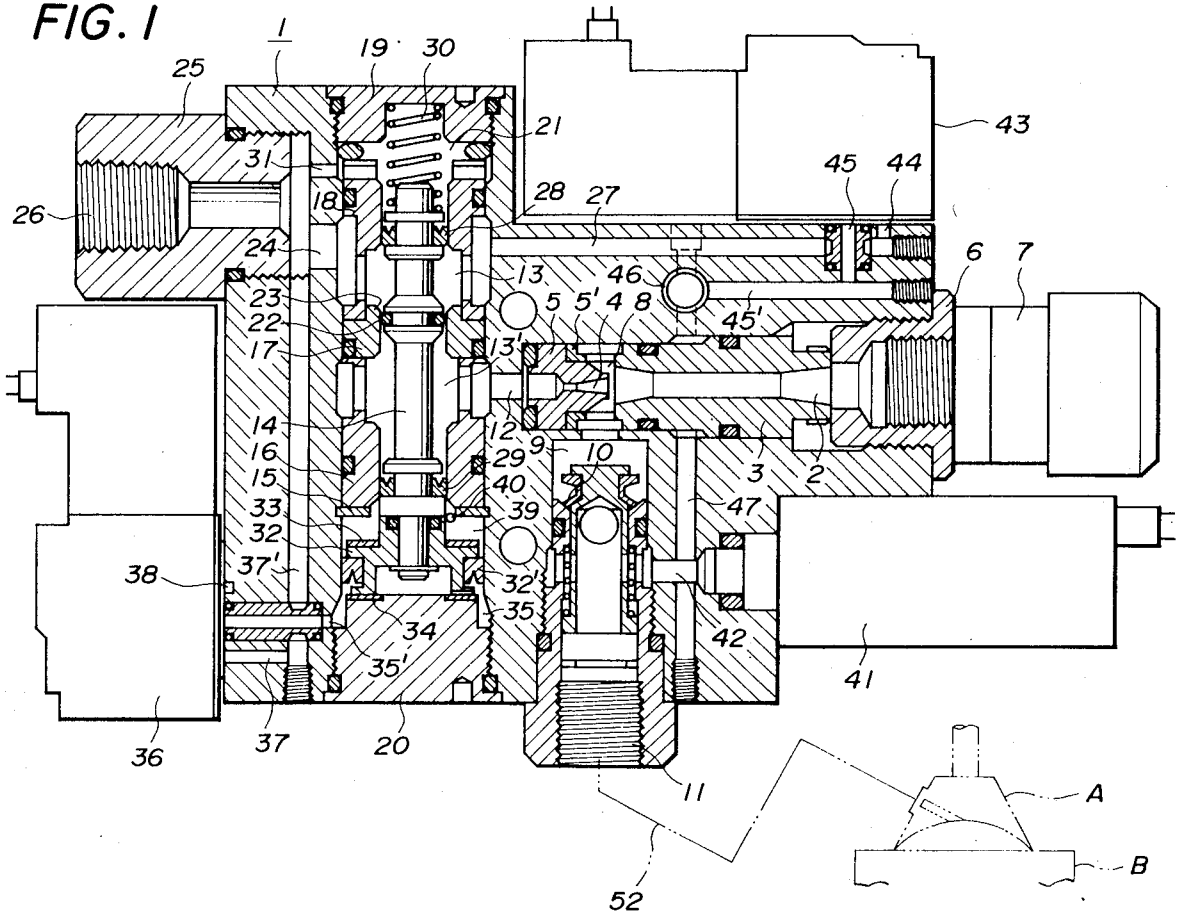
FIG. 1 is a longitudinally sectioned front view showing an ejector pump according to one embodiment of the present invention.

The present invention will be described below in detail in connection with the embodiment thereof with reference to the accompanying drawings. As shown in FIG. 1, a generally flattened pump body 1 is formed with two bores extending in the longitudinal and vertical directions. In the longitudinal bore, there are fitted through a spacer 5' in the recited order from the right-hand or downstream end an ejector block 3 having an ejector hole 2 and a nozzle block 5 having a nozzle hole 4 aligned with the ejector hole 2. At the outer side of the body 1, there is attached a silencer 7 through an adapter 6 by which the aforementioned ejector block and so on are secured in the body bore. Between the nozzle hole 4 and the ejector hole 2, there is formed a suction chamber 8 which communicates through both a communication passage 9 and a check valve 10 fitted in the passage 9, with a suction port 11 formed in the lower side of the body 1.

In the vertical bore located at the lefthand side of the body 1, there are fitted three sleeves 16, 17 and 18 which are so placed in the recited order that the lowermost one 16 is seated on the upper face of a snap ring 15 retained in the lower portion of that bore and in these sleeves a spool valve 14 is slidably fitted to form upper and lower valve chambers 13 and 13' in the bore which are partitioned by a slide valve 22 sliding on the inner circumference 23 of the sleeve 17. The lower valve chamber 13' has communication through a communication passage 12 with the aforementioned nozzle hole 4 whereas the upper valve chamber 13 always has communication with the compressed air inlet port 26 of a conduit connector 25 screwed into the outer side of the body 1. Further, the vertical bore has its upper and lower end portions closed by the nuts 19 and 20, respectively, to form at its upper end portion a pressure chamber 21 into which there intrudes the upper end portion of the spool valve 14 held slidably in the sleeve 18 through a packing 28. A spring 30 is compressed between the spool valve 14 and the upper end nut 19. Moreover, the pressure chamber 21 always has communication through a communication passage 31 with the compressed air inlet port 26.

On the other hand, the spool valve 14 has its lower end portion held slidably in the sleeve 16 through a packing 29. On the lower end portion of the spool valve 14, there is secured a larger-diameter piston 32 which is fitted slidably in the lower end portion of the vertical bore through a packing 32'. Indicated at reference numerals 33 and 34 are shock-absorbing members which are made of rubber, synthetic resin or the like and which are mounted on the respective upper face of the piston 32 and the lower end nut 20. Moreover, indicated at reference numeral 40 is a communication passage for venting the gap between the piston 32 and the sleeve 16 to the atmosphere to provide a relief for the air when the piston 32 moves.

Indicated at numeral 36 is a three-way electromagnetic change-over valve which is disposed outside of the body 1 and which has communication through a communication passage 35' with a pressure chamber 35 formed below the lower face of the aforementioned piston 32. The communication passage 35' is normally open to the atmosphere through valve 36 and the communication passage 38, and can be switched to communicate with the compressed air inlet port 26 through communication passages 37 and 37' when the solenoid of valve 36 is actuated or energized. A typical three-way electromagnetic change-over valve is manufactured by JAPAN JOUCOMATIC CO. LTD., Seiwa Bldg., No. 12-15, Shiba Daimon 1-chome, Minato-ku, Tokyo, Japan as Part No. JC-30-SC.

Indicated at numeral 41 is a vacuum switch which is disposed outside of the body 1, and has its pressure chamber defined by a bellows or the like to communicate through a communication passage 42 with the suction port 11 as a pressure sensor. When the vacuum prevailing in the system connected to the suction port 11 reaches a predetermined level, the vacuum switch 41 opens a contact attached to its pressure chamber to interrupt the power supply to the solenoid of the change-over valve 36 so that the spool valve 14 interrupts supply of the compressed air and the operation of the pump stops accordingly. When the vacuum level is dropped, on the other hand, the vacuum switch 41 closes the contact to restart the pump. A typical vacuum switch is manufactured by JAPAN JOUCOMATIC CO. LTD., Seiwa Bldg., No. 12-15, Shiba Daimon 1-chome, Minato-ku, Tokyo, Japan as Part No. JC-20-SC.

Indicated at numeral 43 is a vacuum relieving electromagnetic on-off valve which is placed on the upper face of the body 1 and which has one port 44 communicating through a communication passage 27, the upper valve chamber 13 of the spool valve 14 and the communication passage 24 with the compressed air inlet port 26 and its other port 45 communicating through a communication passage 45', a flow regulator valve 46, communication passages 47 and 42 and so on with the suction port 11 so that it feeds the suction port 11 with the compressed air when it is actuated. A typical electromagnetic on-off valve is manufactured by MYOTOKU LTD., No. 6-18, Shimomaruko 2-chome, Ota-ku, Tokyo, Japan as Part No. MVS-030.

Figure 2:
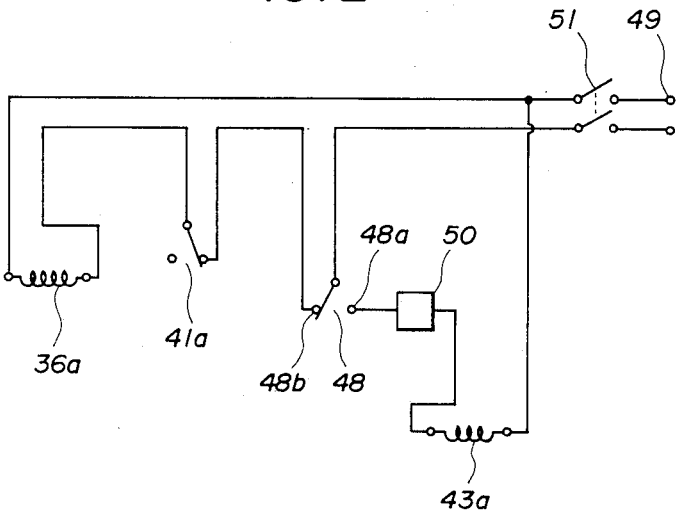
FIG. 2 is a wiring diagram showing the electric circuit of the ejector pump of FIG. 1.

FIG. 2 is a wiring diagram showing one example of the circuit of the ejector pump of the present invention. The electromagnetic change-over valve 36 has its solenoid **36*a* connected together with the (normally-closed) contact 41*a* of the vacuum switch 41 and a pump-actuating separate change-over switch 48 in series with a power supply 49. The change-over switch 48 has its open contact 48*a* connected through a timer 50 with the solenoid 43*a* of the vacuum relieving electromagnetic on-off valve 43. Reference numeral 51** indicates a main switch.

The operations of the ejector pump thus constructed will be described in the following. If the suction port 11 in the lower face of the body 1 is connected through a conduit 52 with a sucking disc A of a vacuum grasping device, for example, and if the inlet port 26 at the left-hand side is connected to a compressed air supply such as a compressor and is supplied with compressed air, this air flows through the communication passage 24 into the upper valve chamber 13 of the spool valve 14 and further through the communication passage 27 into one port 44 of the electromagnetic on-off valve 43. Moreover, the compressed air flows from the inlet port 26 through the communication passage 31 into the upper pressure chamber 21 of the spool valve 14 and further through the communication passages 37' and 37 into the electromagnetic change-over valve 36 which is left unactuated, and the pressure chamber 35 of the piston 32 is vented through the communication passage 38 to the atmosphere. As a result, the spool valve 14 is moved down by the high pressure air prevailing in the upper pressure chamber 21, the valve chamber 13 and so on and by the action of the spring 30 so that the valve chambers 13 and 13' are disconnected from each other by the slide valve 22. Thus, the ejector pump is left out of operation.

Next, if the main switch 51 is turned on and the change-over switch 48 is shifted to the closed contact **48*b*, the solenoid 36*a* is energized to actuate the electromagnetic change-over valve 36. Then, the compressed air flows through the communication passage 35' into the pressure chamber 35 at the back of the piston 32 to elevate the larger-diameter piston 32 against the pressure of the upper pressure chamber and the depressing force of the spring 30 by the difference of pressure receiving areas. As a result, the slide valve 22 is opened to pass the air under high pressure within the valve chamber 13 through the valve chamber 13' and communication passage 12 and it from the nozzle hole 4 into the ejector hole 2 thereby to suck the air in the sucking disk A through suction chamber 8 into the ejector hole 2 until it is released to the atmosphere through the silencer 7. As a result, the sucking disk A has its inside evacuated to attract an article B so that the article B can be transported to a desired place. Thus, when the vacuum in the vacuum system reaches a predetermined level, the vacuum switch 41*a* is turned off to deenergize the solenoid 36*a* so that the ejector pump is stopped. Since the vacuum system is held at a predetermined vacuum level by the check valve 10, however, there is no consumption of compressed air. When the vacuum level has dropped as a result of air leakage, the vacuum switch 41*a*** is turned on to restore the pressure of the system restore to the predetermined high vacuum level.

After the article B has been transported, the energization of the solenoid **36*a* is interrupted, by shifting the change-over switch 48 to the open contact 48*a*, so that the ejector pump is stopped and concurrently the solenoid 43*a* of the vacuum relieving on-off valve 43 is energized through the timer 50 for a predetermined time to open the on-off valve 43. As a result, the compressed air is forced to flow from the other port 45 of the vacuum relieving on-off valve 43 through the communication passage 45', the flow regulator valve 46 and the communication passages 47 and 42 to the suction port 11, so that the vacuum in the sucking disk A can be rapidly relieved to set the article B free. The supply rate and time of the compressed air can be adjusted by the actions of the flow regulator valve 46 and the timer 50**, respectively.

As has been described hereinbefore, according to the present invention, the pump body 1 is equipped with the spool valve 14, which is actuated by the electromagnetic change-over valve 36 disposed outside of the body 1 to open or close the passage providing the communication of the nozzle hole 4 with the compressed air inlet port 26 by means of the slide valve 22 of the spool valve 14. As a result, there can be attained the advantage that the compressed air can be supplied at a high flow rate to establish a strong sucking force by means of the relatively small-sized electromagetic change-over valve. Further, the ejector of the prior art, in which the nozzle is to be opened or closed by the leading end of a pilot valve fitted slidably in the body, has the drawback that the opening or closing operation cannot be conducted smoothly because the shock-absorbing member at the leading end of the valve is forced to plug the nozzle hole when this nozzle hole is closed. However, the ejector valve of the present invention has the advantage over the prior art in that its opening and closing operations can be conducted very smoothly because they are effected by the slide valve, as has been described hereinbefore. Since the respective structural components can be assembled compactly in the body 1, moreover, there can be attained the practical result that the pump can be small-sized.

What is claimed is:

1. An ejector pump comprising:

a pump body having a bore therein, a suction port opening at one side of the pump body and a compressed air inlet port opening at another side of the pump body;

a nozzle block having a nozzle hole;

an ejector block having an ejector hole aligned with the nozzle hole of said nozzle block and fitted together with said nozzle block in the bore of said pump body to form a suction chamber between the nozzle hole of said nozzle block and the ejector hole of said ejector block, said suction chamber communicating with the suction port of said pump body;

a spool valve movably disposed in said pump body and having a pressure chamber at one end portion thereof, said spool valve being movable to provide or prevent communication between the nozzle hole and the compressed air inlet port of said pump body;

an electromagnetic change-over valve disposed outside of said pump body for actuating said spool valve by alternately providing communication between the pressure chamber of said spool valve and the compressed air inlet port of said pump body and between the pressure chamber and the atmosphere;

means defining a passage between said suction chamber and said suction port, and a check valve disposed in said passage to check the flow of air from said suction chamber to said port;

a vacuum switch disposed outside of said pump body and having a pressure sensor communicating with said suction port to control said change-over valve and maintain the vacuum at a predetermined level in any vacuum system connected to said suction port; and a vacuum-relieving electromagnetic on-off valve disposed outside of said pump body and having a port communicating with said compressed air inlet port and another port communicating with said suction port and being operative to feed said suction port with the compressed air for a predetermined time interval to relieve the vacuum in any system connected to said suction port.

2. A pump as defined in claim 1, wherein said spool valve is disposed perpendicularly to a line passing through said nozzle hole and said ejector hole.

* * * * *